United States Patent [19]

Rosa

[11] 4,422,646

[45] Dec. 27, 1983

[54] INFRARED TARGET FOR MILITARY APPLICATIONS AND ITS USE

[75] Inventor: Stephen P. Rosa, Bethesda, Md.

[73] Assignee: TVI Energy Corporation, Beltsville, Md.

[21] Appl. No.: 302,878

[22] Filed: Sep. 18, 1981

[51] Int. Cl.[3] ..... F41J 9/12

[52] U.S. Cl. ..... 273/348.1; 219/345; 219/354; 250/495.1; 273/408

[58] Field of Search ..... 273/348, 408; 434/11; 219/345, 354, 548, 549; 250/495.1

[56] References Cited

U.S. PATENT DOCUMENTS

| | | | |
|---|---|---|---|
| 2,545,805 | 3/1951 | Callender | 219/345 |
| 3,397,301 | 8/1968 | Hager | 219/345 |
| 3,878,362 | 4/1975 | Stinger | 219/528 |
| 3,900,654 | 8/1975 | Stinger | 428/214 |
| 3,923,697 | 12/1975 | Ellis | 252/506 |
| 3,993,842 | 11/1976 | Hirsch et al. | 428/421 |
| 3,999,040 | 12/1976 | Ellis | 219/543 |
| 4,055,526 | 10/1977 | Kiyokawa et al. | 219/548 X |
| 4,064,074 | 12/1977 | Ellis | 252/506 |
| 4,240,212 | 12/1980 | Marshall et al. | 434/11 |
| 4,250,398 | 2/1981 | Ellis et al. | 219/345 |
| 4,260,160 | 4/1981 | Ejnell | 273/408 |
| 4,346,901 | 8/1982 | Booth | 273/408 |

*Primary Examiner*—Anton O. Oechsle

*Attorney, Agent, or Firm*—Beveridge, DeGrandi, Kline

[57] ABSTRACT

An electrically operated military target capable of emitting an infrared signal when an electric current passes therethrough comprises a multiplicty of independent modules, each module corresponding to a thermal cue of a military threat asset. Each module is a unitary, composite, flexible laminate capable of conducting an electric current. Each module is provided with redundant circuitry for connection to a power source. The laminate is covered by a flexible, thermal insulating pad containing a multiplicity of discrete air-containing cells through which the infrared signal can pass. The target is useful for live fire training with thermal sights.

14 Claims, 5 Drawing Figures

INFRARED TARGET FOR MILITARY APPLICATIONS AND ITS USE

BACKGROUND OF THE INVENTION

This invention relates to an electrically operated military target capable of emitting an infrared signal when an electrical current is passed therethrough and use of the target in live fire training.

With the advent of thermal sights for aiming military weapons, there arose a need for targets suitable for live fire training. The thermal sights now in use detect an infrared signal characteristic of the target. This infrared signal is also termed an infrared signature. The target is typically an enemy tank or other vehicle, which would be very costly to use for live firing training.

SUMMARY OF THE INVENTION

This invention provides a low cost thermal target suitable for use in live fire training with thermal sights. More particularly, this invention provides an electrically operated military target capable of emitting an infrared signal when an electric current is passed therethrough. The target comprises a multiplicity of modules, each module corresponding to a thermal cue of a military threat asset. Each module is a unitary, composite, flexible laminate. The laminate comprises electrically insulating top and bottom layers, each layer having an inner surface and an outer surface. A substantially continuous electrically conductive layer of substantially uniform thickness is provided between the inner surfaces of the top and bottom layers. The electrically conductive layer is comprised mainly of carbon. At least two substantially parallel, flexible, electrical conductor means, such as metallic wires or busbars, are provided in contact with the electrically conductive layer. Electrical connector means for connecting each end of each of the wires and busbars to an electrical power source are also provided. The top layer and the bottom layer have edges, which are sealed together to form an enclosed laminate containing the electrically conductive layer and electrical conductor means. Over the outer surface of the top layer is a flexible, thermal insulating pad containing a multiplicity of discrete air-containing cells through which the infrared signal can pass.

This invention also provides a method of using the target of the invention in live fire training using a military weapon provided with a thermal sight capable of detecting an infrared image. The method comprises providing an electrically operated military target in accordance with this invention and generating an infrared image from the target by passing an electric current through the target. The infrared image is then sensed with the thermal sight, and the weapon is fired at the sighted image.

BRIEF DESCRIPTION OF THE DRAWINGS

This invention will be more fully understood by reference to the following illustrations in which like reference numerals represent like parts.

DETAILED DESCRIPTION

Figure 1:
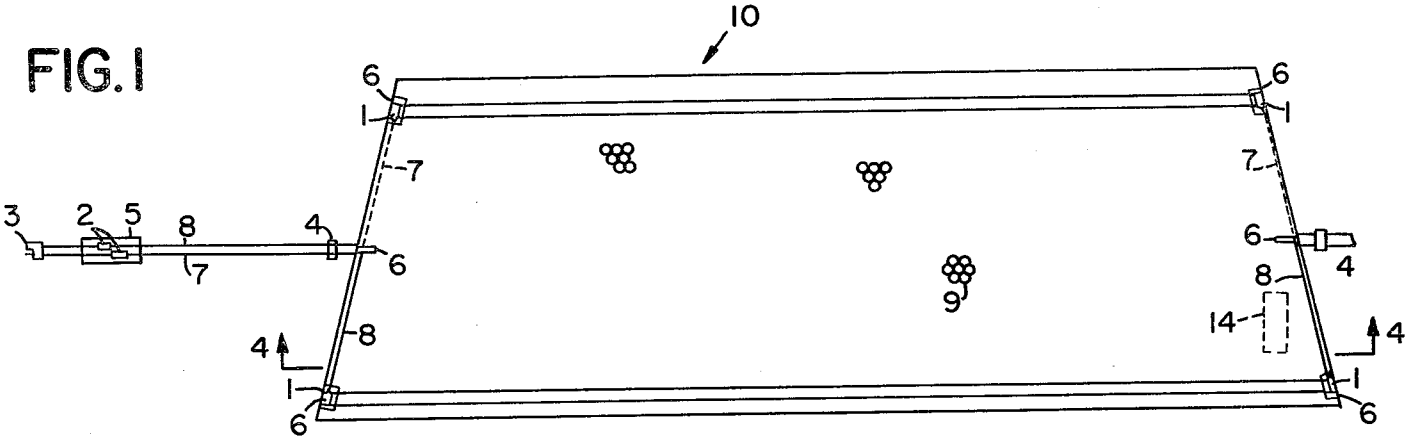
FIG. 1 depicts a module of the invention corresponding to the thermal cue of the turret section of a military tank.
Figure 3:
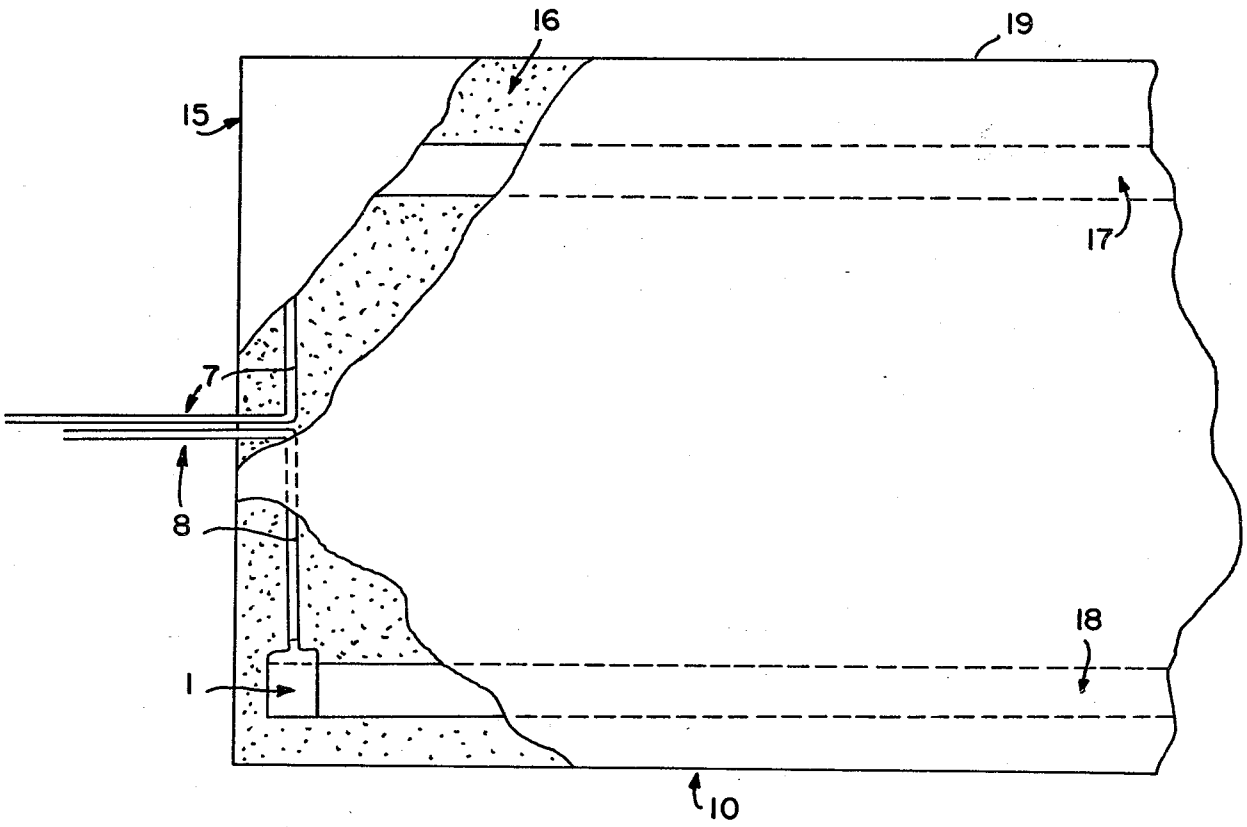
FIG. 3 is a cut-away view of a portion of the module shown in FIG. 2.

Referring to FIG. 1, there is depicted a module of the invention corresponding to the thermal cue of the turret section of a military tank vehicle. The module comprises a unitary, composite, flexible laminate generally shown as 10 in the Figures. FIG. 3 is a cut-away view of the laminate showing its various layers and elements.

In FIG. 3, an electrically insulating bottom layer 15, such as a flexible Mylar film, has thereon an electrically conductive layer 16 of substantially uniform thickness. The electrically conductive layer is comprised mainly of carbon. Typically, the layer will be a substantially continuous graphite-containing layer dispersed in a suitable cured binder system. The layer can also be comprised of a fabric or a web impregnated with graphite, such as a graphite-impregnated asbestos sheet.

Substantially parallel, flexible, metallic conductors, such as wires or busbars 17 and 18, are provided in contact with the electrically conductive layer. The wires or busbars can be provided with an electrically conductive adhesive layer to bond them to the electrically conductive layer 16 or electrically insulating top layer 19, which is also typically a flexible Mylar sheet. Preferably, electrical conductor means 17 and 18 are copper foil strips.

Figure 2:
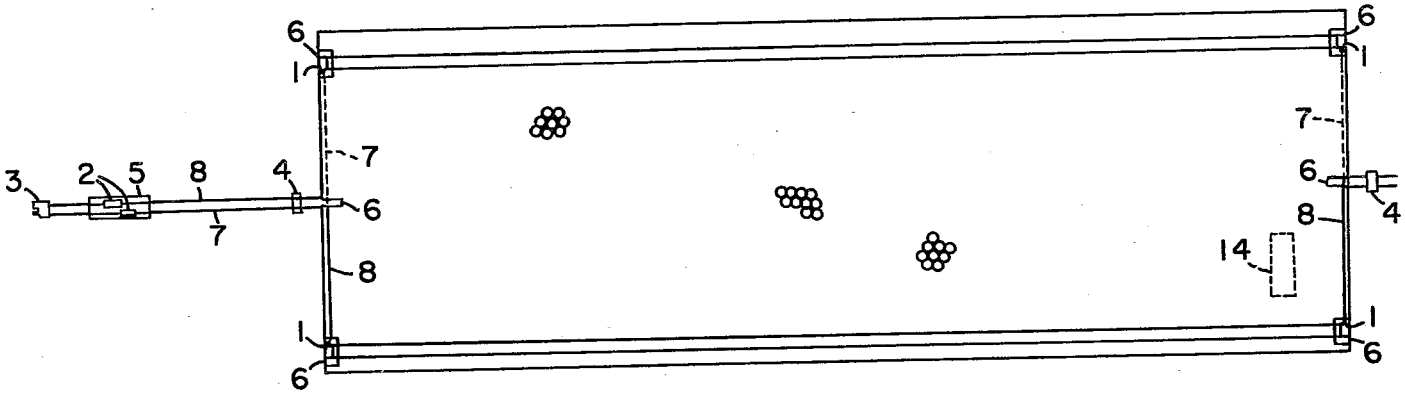
FIG. 2 depicts a module of the invention corresponding to the thermal cue of the hull section of the tank.

In order to connect the conductors 17 and 18 to an external power supply, they are provided with external electrical connectors 3 shown in FIGS. 1 and 2. Connection is made by crimping, soldering, brazing or otherwise securing electrical connectors 1, such as a metallic foil connector, to stranded, metallic wires 7 and 8. Electrical connections of the type described are made at each end of the module of the target.

The top layer 19 is sealed to the bottom layer 15, such as by means of an adhesive Mylar tape, to form an enclosed laminate containing the electrically conductive layer 16 and conductor means 17 and 18.

Figure 4:
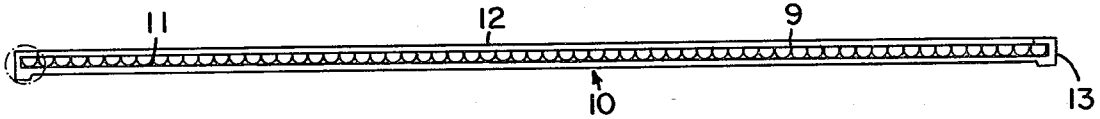
FIG. 4 is a sectional view of the module of FIG. 1, taken along line 4—4 and looking in the direction of the arrows.
Figure 5:
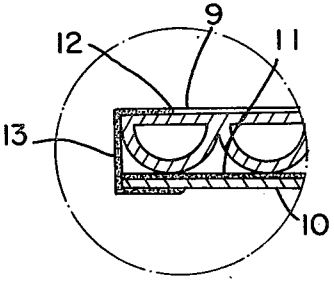
FIG. 5 is an enlarged view of the circled portion of FIG. 4.

Referring to FIGS. 4 and 5, the laminate has in contact with its outer surface a flexible, thermal insulating pad 9 containing a multiplicity of discrete air-containing cells through which infrared energy can pass substantially without distortion or degradation of the infrared signal. This can be readily accomplished by providing an adhesive layer 11 between the thermal insulating pad 9 and the laminate 10. In order to ensure a moisture-proof seal between the thermal insulating pad 9 and the laminate 10, the edges can be taped, such as with a sealing tape 13. Sealing tape 13 can typically be an adhesive Mylar tape. The exposed surface of the thermal insulating pad can then be provided with a suitable decorative or functional coating, 12, such as an olive-drab paint.

In order to strengthen the areas around the electrical connections and the laminate, Mylar tape 6 can be provided in the area covering each electrical junction 1 or splice. In addition, in order to provide proper polarity and avoid error during assembly and use, the wires connecting the electrical conductor means 17 and 18 to an external power supply can be color coded. For example, red, insulated, stranded wires 7 connect one busbar with an external power source at each end of the module, and black, insulated, stranded wires 8 connect the other busbar with a power source. Similar color coding of wires can be used outside the module as shown in FIG. 2. The wires outside the module can then be provided with an electrical connector 3 through insulated butt splices 2, which are covered by a heat shrinkable tubing 5 to protect the electrical connection from environmental and mechanical damage. Vinyl electrical tape 4 can be employed for added strength and protection. When complete, the module can be provided with a suitable identifying label 14.

Referring to FIG. 3, there is depicted a module of the invention corresponding to the thermal cue or thermal signature of the hull section of a military tank. It is substantially identical in construction to the module corresponding to the turret section depicted in FIG. 1. The difference is in the shape of the module. It will be understood that the module can have any configuration so that its shape will correspond to the thermal cue or thermal image of all or part of a military threat asset, such as an enemy military vehicle or weapon system. In addition to the two modules shown in the Figures, additional modules can be provided. For example, modules corresponding to the wheels or tracks of the vehicle can also be provided. Similarly, a module corresponding to the image projected by the front of a vehicle can be added. By the addition of suitable modules, three-dimensional objects emitting infrared signals can be provided. This is particularly advantageous when the targets are used for live fire training from aircraft.

In operation, each of the modules is connected to an electrical power source. An electrical current passes through the connecting wires 7 and 8 to busbars 17 and 18 and then through the electrically conductive layer 16. This results in each module emitting an infrared signal over its entire surface. Thus, the shape and size of the module can be tailored to represent any portion of an enemy object, and even only a small portion of the object corresponding to the aim point of the sight. In addition, each module emits thermal energy. The thermal insulating pad 9 faces the thermal sight so that the infrared signal emitted by the target can be detected by the sight. The thermal insulating pad 9 permits the passage of the infrared signal while retaining the heat in the panel. Excess heat loss from the panel degrades the quality of the infrared signal. Thermal insulating pad 9 minimizes heat loss and maintains the module at a relatively constant temperature notwithstanding environmental conditions during operation.

The module can be mounted, such as by stapling, onto a rigid surface, such as a plywood sheet. When the target of this invention is fired upon, the projectile penetrates one of the target modules. Ordinarily, the weapon will be aimed toward the center of a module resulting in the module being completely perforated. Subsequently fired projectiles will pass through the same area of the module if accurately fired. Puncturing the module does not necessarily disable it. For example, if the busbars 17 and 18 are intact, electric current can still pass through the remaining portions of the electrically conductive layer 16. Furthermore, even if the connection between electrical conductor 17 or 18 and the power supply via leads 7 or 8 at one end of the module is interrupted, electric power is still provided by the connections at the other end of the module. Thus, the target can be subjected to repeated hits over an extended period of time without destroying the usefulness of the target.

Because of the uniformity provided in the targets of this invention, thermal and visual signals are identical from target to target. Thus, different training crews see identical targets. Firing results can be accurately graded and compared between tactical units. Furthermore, firing conditions can be duplicated from day to day with the only variable being environmental conditions.

Because of the modular design, target sections are separate and independent of one another so that damage to one module, for instance a turret section, has no effect on the signal emitted by remaining portions of the target. Furthermore, because of redundant circuitry, even a hit incapacitating one portion of a module will not necessarily incapacitate the entire module. Of course, destroyed modules can be readily replaced without affecting the operable modules. Because each module corresponds to a thermal cue of a military threat asset, the targets of the invention provide exact doctrinal aim points.

Each target module can be separately controlled, if desired, to increase training realism with hot or cold surfaces. For example, energizing appropriate modules makes it possible to depict hot or cold road wheels or vehicle tracks.

Each target module can be quickly repaired on site using simple tools and inexpensive materials. This makes it possible to extend the life of the targets.

The thermal and electrical characteristics of each module are dependent upon the construction features. In turn, the characteristics of the infrared signal can be varied depending upon the thermal and electrical characteristics of the module. In one embodiment of this invention, the target is comprised of modules emitting different infrared signals. This can be conveniently accomplished by changing the resistivity of the electrically conductive layer, such as by employing conductive layers having different compositions or conductive layers having the same composition but different thicknesses in the modules comprising the target.

What is claimed is:

1. An electrically operated military target capable of emitting an infrared signal when an electric current from an electrical power source having two poles is passed therethrough, said target comprising a multiplicity of modules, each module corresponding to a thermal cue of a military threat asset, wherein each module is a unitary, composite, flexible, laminate comprising:

(A) flexible, electrically insulating top and bottom layers, each layer having inner and outer surfaces;

(B) a substantially continuous flexible, electrically conductive layer of substantially uniform thickness between said inner surfaces, wherein said electrically conductive layer is comprised of carbon;

(C) at least two substantially parallel flexible, metallic busbars in contact with said electrically conductive layer each of said busbars having two ends;

(D) a first electrical connector means for connecting both ends of one of said busbars to one pole of an electrical power source;

(E) a second electrical connector means for connecting both ends of another of said busbars to the other pole of the electrical power source;

Wherein said top layer and said bottom layer have edges, which are sealed together to thereby form an enclosed laminate containing the electrically conductive layer; and said outer surface of said top layer is covered by a flexible, thermal insulating pad containing a multiplicity of discrete air-containing cells through which said infrared signal can pass.

2. A target according to claim 1 wherein said target comprises at least two of said modules, wherein one module corresponds to the thermal cue of the turret section of a military tank vehicle and the other module corresponds to the thermal cue of the hull section of said vehicle.

3. A method of live fire training using a military weapon provided with a thermal sight capable of detecting an infrared image, said method comprising providing an electrically operated military target in accordance with claims 1 or 2; generating an infrared image from the target by passing an electric current through the target; sensing the infrared image with the thermal sight; and firing the weapon at the sighted image.

4. A target as claimed in claim 1 wherein each of said modules presents a thermal cue of a military threat asset and the plurality of modules are adapted to be arranged to present the thermal signature of such threat asset.

5. A target as claimed in claim 1 wherein said modules present the thermal cues of personnel.

6. A target as claimed in claim 1 wherein said modules present the thermal cues of aircraft.

7. A target as claimed in claim 1 wherein each of said modules presents a thermal cue of a military threat asset as viewed from different angles and the multiplicity of modules are adapted to be arranged to present said thermal cues to viewers at different angles to present a three dimensional target.

8. A target as claimed in claim 1 wherein said air-containing cells in said insulating pad are arranged in a single layer of cells.

9. A target assembly comprising a multiplicity of modules as claimed in claim 1, a rigid support surface for supporting said modules and an electrical power source having two poles for connection to said first and second electrical connectors.

10. A target assembly as claimed in claim 9 wherein said rigid support surface includes a sheet of plywood.

11. A target assembly as claimed in claim 9 further comprising means for separately controlling the electric current passed through each module.

12. An electrically operated military target module capable of emitting an infrared signal when an electric current from an electrical power source having two poles is passed therethrough comprising a unitary, composite laminate including:

(A) electrically insulating top and bottom layers, each layer having inner and outer surfaces;

(B) a substantially continuous, electrically conductive layer of substantially uniform thickness between said inner surfaces, wherein said electrically conductive layer is comprised of carbon;

(C) at least two substantially parallel metallic busbars in contact with said electrically conductive layer, each of said busbars having two ends;

(D) a first electrical connector means for connecting both ends of one of said busbars to one pole of an electrical power source;

(E) a second electrical connector means for connecting both ends of another of said busbars to the other pole of the electrical power source;

wherein said top layer and said bottom layer have edges, which are sealed together to thereby form an enclosed laminate containing the electrically conductive layer; and said outer surface of said top layer is covered by a thermal insulating pad containing a multiplicity of discrete air-containing cells through which said infrared signal can pass.

13. An electrically operated military target module capable of emitting an infrared signal when an electric current from an electrical power source having two poles is passed therethrough comprising a unitary, composite, flexible, laminate including:

(A) flexible, electrically insulating top and bottom layers, each layer having inner and outer surfaces;

(B) a substantially continuous, flexible, electrically conductive layer of substantially uniform thickness between said inner surfaces, wherein said electrically conductive layer is comprised of carbon;

(C) at least two substantially parallel flexible, metallic busbars in contact with said electrically conductive layer, each of said busbars having two ends;

(D) a first electrical connector means for connecting both ends of one of said busbars to one pole of an electrical power source;

(E) a second electrical connector means for connecting both ends of another of said busbars to the other pole of the electrical power source;

wherein said top layer and said bottom layer have edges, which are sealed together to thereby form an enclosed laminate containing the electrically conductive layer; and said outer surface of said top layer is covered by a flexible, thermal insulating pad containing a multiplicity of discrete air-containing cells through which said infrared signal can pass.

14. An electrically operated military target capable of emitting an infrared signal when an electric current from an electrical power source having two poles is passed therethrough, said target comprising a multiplicity of modules, each module corresponding to a thermal cue of a military threat asset, wherein each module is a unitary, composite, laminate comprising:

(A) electrically insulating top and bottom layers, each layer having inner and outer surfaces;

(B) a substantially continuous, electrically conductive layer of substantially uniform thickness between said inner surfaces, wherein said electrically conductive layer is comprised of carbon;

(C) at least two substantially parallel metallic busbars in contact with said electrically conductive layer, each of said busbars having two ends;

(D) a first electrical connector means for connecting both ends of one of said busbars to one pole of an electrical power source;

(E) a second electrical connector means for connecting both ends of another of said busbars to the other pole of the electrical power source;

wherein said top layer and said bottom layer have edges, which are sealed together to thereby form an enclosed laminate containing the electrically conductive layer; and said outer surface of said top layer is covered by a thermal insulating pad containing a multiplicity of discrete air-containing cells through which said infrared signal can pass.

* * * * *